United States Patent [19]

Mainville

[11] Patent Number: 4,911,272

[45] Date of Patent: Mar. 27, 1990

[54] SPRING-LOADED MECHANISM FOR OPENING AND CLOSING A BRIEFCASE

[76] Inventor: Yvan Mainville, 8 Sabourin, St. Isadore, Ontario, K0C 2B0, Canada, K0C 2B0

[21] Appl. No.: 349,207

[22] Filed: May 8, 1989

Related U.S. Application Data

[63] Continuation-in-part of Ser. No. 235,501, Aug. 24, 1988, abandoned.

[51] Int. Cl.[4] ..... A45G 13/34

[52] U.S. Cl. ..... 190/106; 217/60 E; 217/60 G

[58] Field of Search ..... 190/106; 217/60 R, 60 B, 217/60 C, 60 D, 60 E, 60 F, 60 G, 61

[56] References Cited

U.S. PATENT DOCUMENTS

| | | | |
|---|---|---|---|
| 461,485 | 10/1891 | McCabe | 217/60 E |
| 829,385 | 8/1906 | Brennan, Jr. | 217/60 E |
| 934,149 | 9/1909 | Englerth | 217/60 G |
| 1,194,708 | 8/1916 | Buckwalter | 217/60 E |
| 1,207,946 | 12/1916 | Levanseler | 217/60 E |
| 1,296,260 | 3/1919 | Blood | 217/60 G |
| 1,370,135 | 3/1921 | Levanseler | 217/60 E |
| 1,409,857 | 3/1922 | Hillson | 217/60 G |
| 4,429,933 | 2/1984 | Sokolowski | 217/60 E |

FOREIGN PATENT DOCUMENTS

| | | | |
|---|---|---|---|
| 447785 | 5/1936 | United Kingdom | 217/60 E |

*Primary Examiner*—William Price

*Attorney, Agent, or Firm*—Lowe, Price, LeBlanc, Becker & Shur

[57] ABSTRACT

A closure device for a container having a lid hingedly attached at an attachment edge between one lower edge of the lid and a corresponding upper edge of the container comprises a spring means pivotally connected at a first end at a pivot point to a wing means capable of secure attachment to a hinged brace means. The brace means is mounted at its respective ends to an inside wall of the lid and a corresponding inside wall of the container. A second end of the spring means is adapted to be mounted on the inside wall of the container at such a distance from the brace means that when the lid is in a closed position the angle at the pivot point beneath the point exceeds 180 degrees, and when the lid is in an open position the same angle is less than 180 degrees.

9 Claims, 4 Drawing Sheets

SPRING-LOADED MECHANISM FOR OPENING AND CLOSING A BRIEFCASE

CROSS REFERENCE TO RELATED APPLICATION

This application is a continuation-in-part of U.S. patent application Ser. No. 235,501, filed Aug. 24, 1988 and now abandoned.

FIELD OF THE INVENTION

This invention relates to a closure device, in particular to a closure device for lidded containers such as briefcases.

BACKGROUND OF THE INVENTION

Devices relating to the opening of containers such as briefcases are known, either for bracing a case open when the body of the case is in a horizontal position, or for assisting in the opening process. Other devices such as locks or clasps assist in the closure process. Devices for bracing open generally consist of hinged brackets mounted close to the inside wall of the sides of the lid and the body of the case, and require the use of two hands to hold the lid up while engaging a pin or similar means to lock the device in an open position. Similarly, such devices generally require the use of two hands for disengagement. Another form of device for bracing open includes a spring means, which assists in the opening proeess as well as in maintaining the open position. Closure of a case having such device installed, however, requires the continuous use of force to counteract the force of the spring until the lid is in a fully closed position

SUMMARY OF THE INVENTION

It is an object of the present invention to provide an improved mechanism for opening and closing lidded containers which obviates and mitigates from the disadvantages of the prior art.

It is a further object of the present invention to provide a device which assists in the opening process, so that the lid of the case can reach and be maintained in a fully open position simply, requiring the use of only one hand, yet not require any significant continuous force for the closure process. The invention moreover assists in the closure process, again requiring the use of only one hand. A further preferred feature of the invention is that in assisting in the closure process, it prevents the lid from opening if the case is inadvertently lifted by the handle without closing the locks.

According to the present invention therefore, there is provided a closure device for a container having a lid hingedly attached at an attachment edge between one lower edge of said lid and a corresponding upper edge of said container, comprising a resilient means pivotally connected at a first end at a pivot point to a wing means capable of secure attachment to a hinged brace means, said brace means being mounted at its respective ends to an inside wall of said lid and a corresponding inside wall of said container, a second end of said spring means being adapted to be mounted such that when said lid is in a closed position the angle at said pivot point beneath said point exceeds a predetermined angle, and when said lid is in an open position said angle is less than said predetermined angle.

BRIEF DESCRIPTION OF THE DRAWINGS

Preferred embodiment of the present invention will be better understood from the following detailed description with reference to the drawings, in which.

DETAILED DESCRIPTION OF THE PREFERRED EMBODIMENTS

Figure 1:
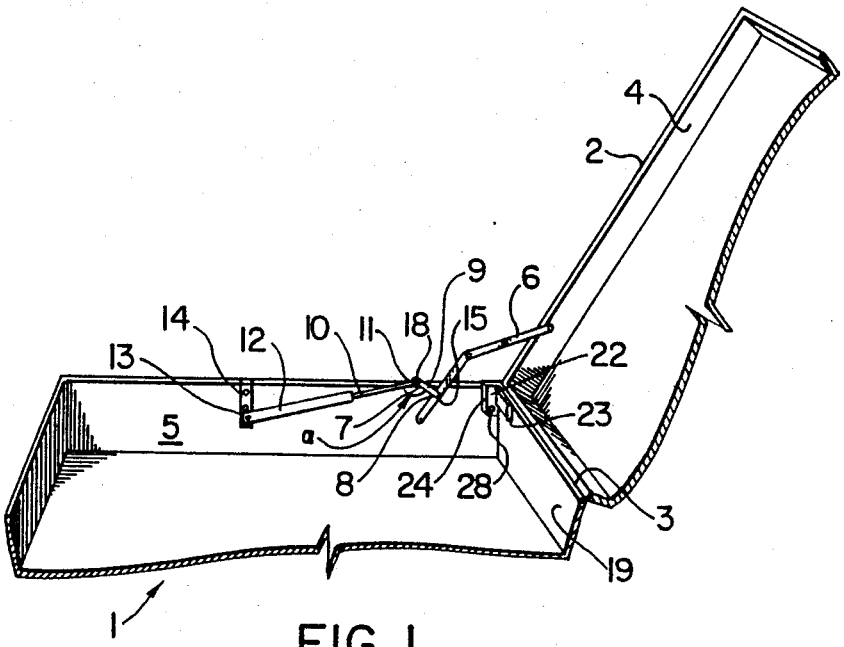
FIG. 1 is a perspective view of an embodiment of the invention installed in a briefcase shown in an open position.

Referring to FIG. 1, a briefcase or similar container 1 has a lid 2 attached by hinges (not shown) along an attachment edge 3. A hinged bracket or brace means 6 is connected at its respective ends to the inside side wall 4 of the lid 2 and the inside wall 5 of the container 1.

Attached to the brace means 6, by an adjustable fastening means such as a screw 15, is a first end 8 of a wing 7. The other end 9 of the wing 7 is pivotally attached to the end 11 of a cylinder rod 10 of a spring means such as a spring loaded cylinder 12, which in turn is attached at its end 13 to a mounting means 14 such as an inverted U-shaped bracket, for secure attachment to the inside wall 5 of the container 1.

The device is adapted for mounting on one or both sides of the case. The embodiment shown in FIG. 1 is adapted to be mounted to a typical brace means 6 installed many commercially available cases, but if such brace means 6 is not already installed, the same can readily be added with the device of the invention.

Figure 2:
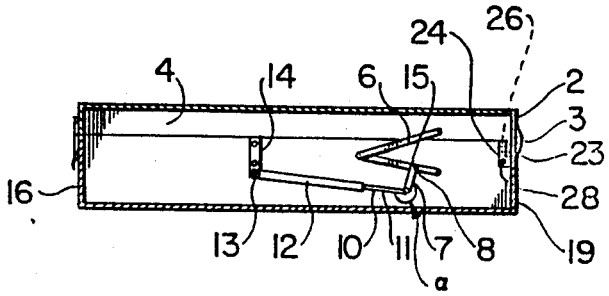
FIG. 2 is a side elevation view of an embodiment of the invention in the closed position.

In operation, the device functions as follows. When the case is in a closed position, the device is as shown in FIG. 2 The wing 7 and the rod 10 form an angle beneath a pivot point 18 therebetween of more than 180°, and the force of the spring means 12 works on the wing 7 and the brace means 6 to hold the lid 2 in the closed position. When it is desired to open the case, the locks or other fastening means (not shown) on the outer edge 16, opposite to the attachment edge 3 of the container 1, are opened, and the lid 2 can be lifted by a single hand. As the lid starts to move, a slight upward force is required to overcome the action of the spring 12 which tends to hold the lid 2 in the closed position, but as soon as the angle "a" between rod 10 and wing 7 is less than 180°, the force of spring 12 acts to complete the opening process. The lid 2 will then be held in the open position shown in FIG. 1 as long as desired, without the need for complex support means or the use of two hands to lock the brace means 6 into position.

When it is desired to close the case, the process is reversed. Initially a small force is required to overcome the tendency of the spring means 12 to hold the lid 2 in the open position, but once the wing 7 and the rod 10 are again in line and the pivot angle increases above 180°, the force of the spring means 12 acts to complete the closing process by pulling the end 9 further downwards to close the lid and to hold it in a closed position.

Over time, the action of cylinder 12 may cause some separation between side wall 5 and rear wall 19 of container 1. These corners may therefore be usefully reinforced in any suitable fashion. One such reinforcement is shown in FIG. 1 in the form of an inverted U-shaped bracket 22 including a flange 23. Sides 24 of bracket 22 include small countersunk holes 26 to receive therethrough threaded fasteners 28 to connect the bracket to side wall 5 so that flange 23 flush fits against rear wall 19. Flange 23 prevents rear wall 19 from being pulled inwardly into the interior of the briefcase due to the forces exerted by spring means 12. Other forms of reinforcement will of course readily occur to those skilled in the art.

The device is so constructed and mounted that the force of the spring means 12 is sufficient to hold the lid 2 in the closed position even if the case is lifted by its handle (not shown) without first fastening the locks or fastening means (not shown).

One possible disadvantage of the closure device as described above is that holes for the fasteners holding mounting means 14 must made be made in the inner walls 5 of the briefcase. This is of some concern as the present device is so constructed so as to be removable in the event that it is not required, or the user otherwise wishes to remove it for any reason. It would therefore be advantageous to modify the device to maintain the same principles of operation but without requiring any permanent marks in the walls of the case presenting an unsightly or disfigured appearance if the device is temporarily removed. At least two such modifications will now be described with reference to FIGS. 3 to 5.

Figure 3:
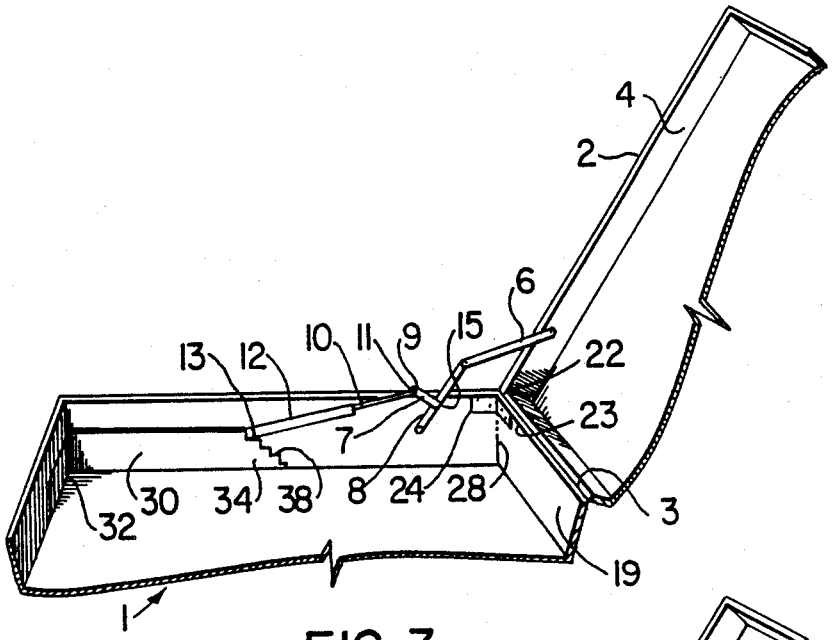
FIG. 3 is a perspective view of a modified embodiment of the closure device.

With reference to FIG. 3, bracket 14 is completely eliminated in favour of a right angle flange 30 that fits conformably into front lower corner 32 of case 1 without any fastening means whatsoever. The end 34 of flange 30 immediately adjacent end 13 of spring cylinder 12 is formed having a series of angular steps or projections 38 as shown. The end 13 of spring cylinder 12 is typically hollow and will therefore readily engage any one of projections 38 merely by being placed in abutment therewith. The force of spring cylinder 12 acting against flange 30 will maintain the flange firmly seated in corner 32 without the need for any other fastening means holding the flange in place. Flange 30 may advantageously be made of lightweight, transparent and colourless plastics material so as to be practically invisible to the casual observer. When the closure device is removed, flange 30 is removed as well, leaving behind no unsightly marks or other disfigurements whatsoever.

Figure 4:
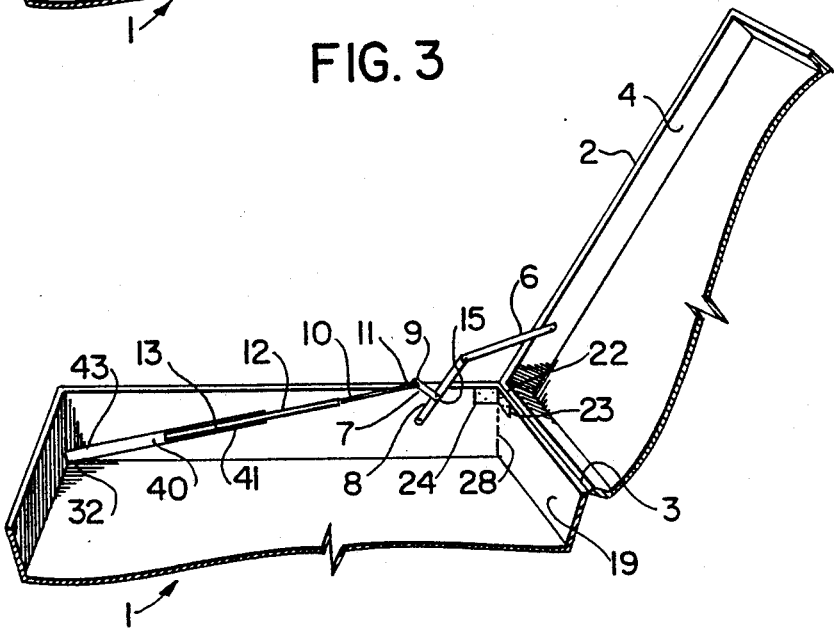
FIG. 4 is a perspective view of a further modified embodiment of the closure device.
Figure 5:
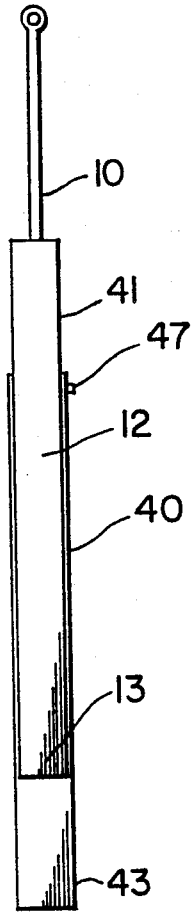
FIG. 5 is a side elevational, cross-sectional view of a cylindrical extension appearing in the embodiment of FIG. 4.

A further modification permitting removal of the closure device will now be described with reference to FIGS. 4 and 5. With reference specifically to FIG. 4, bracket 14 is completely eliminated in favour of an adjustable cylindrical sleeve 40 one end 41 of which receives end 13 of cylinder 12 annularly therein, and the other end 43 of which frictionally fits into corner 32 of case 1 responsive to the biasing force exerted by the spring cylinder. Sleeve 40 is shown in greater detail in FIG. 5 and it will be seen to include a set screw 47 permitting adjustments to the position of sleeve 40 along the length of cylinder 12, depending upon the amount of springinduced opening and closing biasing force desired by the user Once again, the present device, if removed, will leave behind no disfigurements or other holes in the briefcase. The end 43 of sleeve 40 fitting into corner 32 may be flattened if desired so as to occupy less space in the briefcase The cylindrical shape of the sleeve is merely exemplary, and other cross-sectional shapes may be used. The cylinder might even be eliminated using a sufficiently elongated spring cylinder 12 of a length to reach corner 32. Such an elongated spring cylinder might be telescopic in construction to permit adjustments to its length. Using either flange 30 or sleeve 40 reduces the need for internal reinforcements such as brackets 22.

While the invention has been described in connection with the features as described herein, it will be apparent to those skilled in the art that various modifications can be made without departing from the spirit and essence of the present invention. It is to be understood therefore that the invention may be varied within the scope of the claims appended hereto.

I claim:

1. A closure device for a container having a lid hingedly connected thereto and a hinged brace means connected at its respective ends to said container and said lid, comprising:

wing means attachable to said hinged brace means;

spring means having first and second ends, said first end being pivotally connected to said wing means at a pivot point therebetween; and a flange member removably fittable against an inner surface of said container, said flange member having means on an end thereof adapted to releasably engage said second end of said spring means to bias said spring means between said flange member and said pivot point, wherein when said lid is in a closed position thereof an angle between said spring means and said wing means beneath said pivot point therebetween exceeds a predetermined angle, and when said lid is in an open position thereof, said angle is less than said predetermined angle.

2. A closure device as claimed in claim 1 wherein said spring means is a spring loaded cylinder.

3. A closure device for a container having a hinged lid thereon and hinged brace means connected between said container and said lid, comprising:

wing means attachable to said hinged brace means;

spring means having first and second ends, said first end being pivotally connected to said wing means at a pivot point therebetween; and sleeve means having first and second ends, said first end having means adapted for connection to said second end of said spring means and said second end adapted for frictional engagement with an inner surface of said container to thereby bias said spring means between said sleeve means and said pivot point, wherein when said lid is in a closed position thereof the angle between said spring means and said wing means beneath said pivot point therebetween exceeds a predetermined angle, and when said lid is in an open position thereof, said angle is less than the said predetermined angle.

4. The closure device as claimed in claim 3 wherein said spring means is a spring-loaded cylinder.

5. The closure device of claim 1 wherein said means on said flange member adapted to releasably engage said second end of said spring means comprise a plurality of projections for selective engagement with said second end of said spring means.

6. The closure device of claim 5 wherein said flange member comprises a right angle flange for a conformable fit into a corner of said container.

7. The closure device of claim 3 wherein the point of connection of said sleeve means to said spring means is adjustable.

8. The closure device of claim 1 wherein said predetermined angle is 180°.

9. The closure device of claim 5 wherein said predetermined angle is 180°.

* * * * *